US006659814B2

(12) United States Patent
Kojima

(10) Patent No.: US 6,659,814 B2
(45) Date of Patent: Dec. 9, 2003

(54) MALE TERMINAL FITTING AND METHOD OF MANUFACTURE

(75) Inventor: Eiji Kojima, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/291,914

(22) Filed: Nov. 8, 2002

(65) Prior Publication Data

US 2003/0096542 A1 May 22, 2003

(30) Foreign Application Priority Data

Nov. 22, 2001 (JP) ..... 2001-358284

(51) Int. Cl.[7] ..... H01R 9/24; H01R 13/02; H01R 4/18; H01R 4/10

(52) U.S. Cl. ..... 439/884; 439/866; 439/879

(58) Field of Search ..... 439/884, 850, 439/866, 879

(56) References Cited

U.S. PATENT DOCUMENTS

2002/0111082 A1 * 8/2002 Murakami et al. ..... 439/884
2002/0182943 A1 * 12/2002 Boemmel et al. ..... 439/745
2003/0017755 A1 * 1/2003 Murakami et al. ..... 439/849
2003/0060091 A1 * 3/2003 Fukatsu ..... 439/884

FOREIGN PATENT DOCUMENTS

JP 4-39880 2/1992

* cited by examiner

*Primary Examiner*—Chandrika Prasad
(74) *Attorney, Agent, or Firm*—Gerald E. Hespos; Anthony J. Casella

(57) ABSTRACT

A male tab (3) is formed by bending an electrically conductive plate. The male tab (3) has a first panel (3A), a second panel (3B) opposed to the first panel (3A), a connecting panel (3C) connecting the first and second panels (3A, 3B), and a foldable support panel (3D) folded from the second panel (3B). The foldable support panel (3D) is held in close contact with the front and rear panels (3A, 3B) and prevents the leading ends of the first and second panels (3A, 3B) from being inclined inward during the pressing.

9 Claims, 11 Drawing Sheets

MALE TERMINAL FITTING AND METHOD OF MANUFACTURE

BACKGROUND OF THE INVENTION

1. Field of the Invention

The present invention relates to a male tab, to a male terminal fitting provided therewith and to a method of forming it.

2. Description of the Related Art

A known male terminal fitting is identified by the numeral 100 in FIGS. 8 and 9, and also is disclosed in Japanese Unexamined Patent Publication No. 4-39880. The male terminal fitting 100 is formed by bending an electrically conductive plate to define a male tab 101 with a front end that is connectable with an unillustrated mating female terminal fitting. The male tab 101, as shown in FIG. 9, achieves a specified thickness T by providing a bottom wall 102 and bending opposite sidewalls 103 on the upper surface of a leading end of the bottom wall 102.

Connectors for automotive vehicles and the like have been made smaller in recent years to accommodate a demand for miniaturization of connectors. Small terminal fittings for such miniaturized connectors also have been developed. However, miniaturized male terminal fittings may experience some problems that may not be experienced by the conventional male terminal fitting 100. For example, the electrically conductive plate is too thin to achieve the specified thickness for the male tab 101 by the conventional forming method.

FIGS. 10 to 12 show a male terminal fitting 110 with a male tab 111 that may be considered to address the above-described problem. The male terminal fitting 110 is formed by bending the electrically conductive plate 114 of FIG. 10 to define a male tab 111 with a specified space S between the upper and lower sides and with a specified thickness T, as shown in FIG. 12. However, the male tab 111 must be press formed by upper and lower molds 115, 116, as shown in FIG. 13. This press forming causes the ends 112 of the plate to move closer to each other from the bends 113 and to incline inwardly along the thickness direction. As a result, the male tab 111 is not flat and has a small contact area with the female terminal fitting.

The present invention was developed in view of the above problem and an object thereof is to provide a male terminal fitting with a male tab having a specified thickness and flatly formed even in the case of using a thinner electrical conductive plate member.

SUMMARY OF THE INVENTION

The invention is directed to a male tab formed by folding an electrically conductive plate to place a first panel of the plate substantially over a second panel thereof. A supporting panel extends from the first and second panels of the electrically conductive plate and is folded and held tightly between the first and second panels. Thus, the supporting panel is between the first and second panels and supports the first and second panels at a distance from each other.

The male tab can be at one end of a male terminal fitting, but also can be used for other parts, such as terminal fittings with male and female connecting portions or coupling terminals with plural male tabs. In the latter terminal, the inventive male tabs may be used for all or part of the male tabs.

As explained above, a supporting panel extends from at least one of the facing sides of the first and second panels of the electrically conductive plate is folded and held tightly between the facing sides to prevent the facing sides from being inclined inwardly along the thickness direction during pressing. Thus, the male tab has a flatter surface. Further, the thickness of the male tab can be enlarged as much as the thickness of the tightly held end. Accordingly, a specified thickness can be ensured even in the case of using a thinner electrically conductive plate.

The support panel held tightly between the first and second panels of the electrically conductive plate may be thinner than other parts of the electrically conductive plate to be formed into the male tab. Accordingly, the tightly held supporting panel can be folded easily. Further, the thinner supporting panel makes it more difficult to form a space at a bent portion when being folded. Therefore, dimensional errors along the thickness direction of the male tab can be reduced.

A connecting panel between the first and second panels with a specified dimension preferably is arranged at an angle to the first and second panels. The first and second panels may be maintained in their positional relationship by the at least one facing end and by the connecting panel.

Most preferably, the first and second panels are substantially parallel.

The invention also relates to a male terminal fitting, such as a terminal fitting with a pair of male and female connecting portions or a coupling terminal. The terminal fitting may comprise a wire-connecting portion to be connected to a wire. A male tab as described above is connected electrically with the wire-connecting portion. The tab and the wire-connecting portion may be unitary with one another.

The invention also relates to a method of forming a male tab. The method comprises folding an electrically conductive plate so that first and second panels are placed substantially one over the other and so that a supporting panel is folded at least on one of the first and second panels and held between the first and second panels. Thus, the first and second panels are placed one over the other while being supported by the supporting panel that is sandwiched between the first and second panels.

The electrically conductive plate preferably is pressed such that the supporting panel has a thickness that is smaller than that of the other parts of the electrically conductive plate.

The electrically conductive plate preferably is folded so that the connecting panel between the first and second panels has a specified dimension and is arranged at an angle to the first and second panels.

The electrically conductive plate preferably is folded so that the first and second panels are maintained in their positional relationship by the at least one facing end portion and by the connecting panel.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
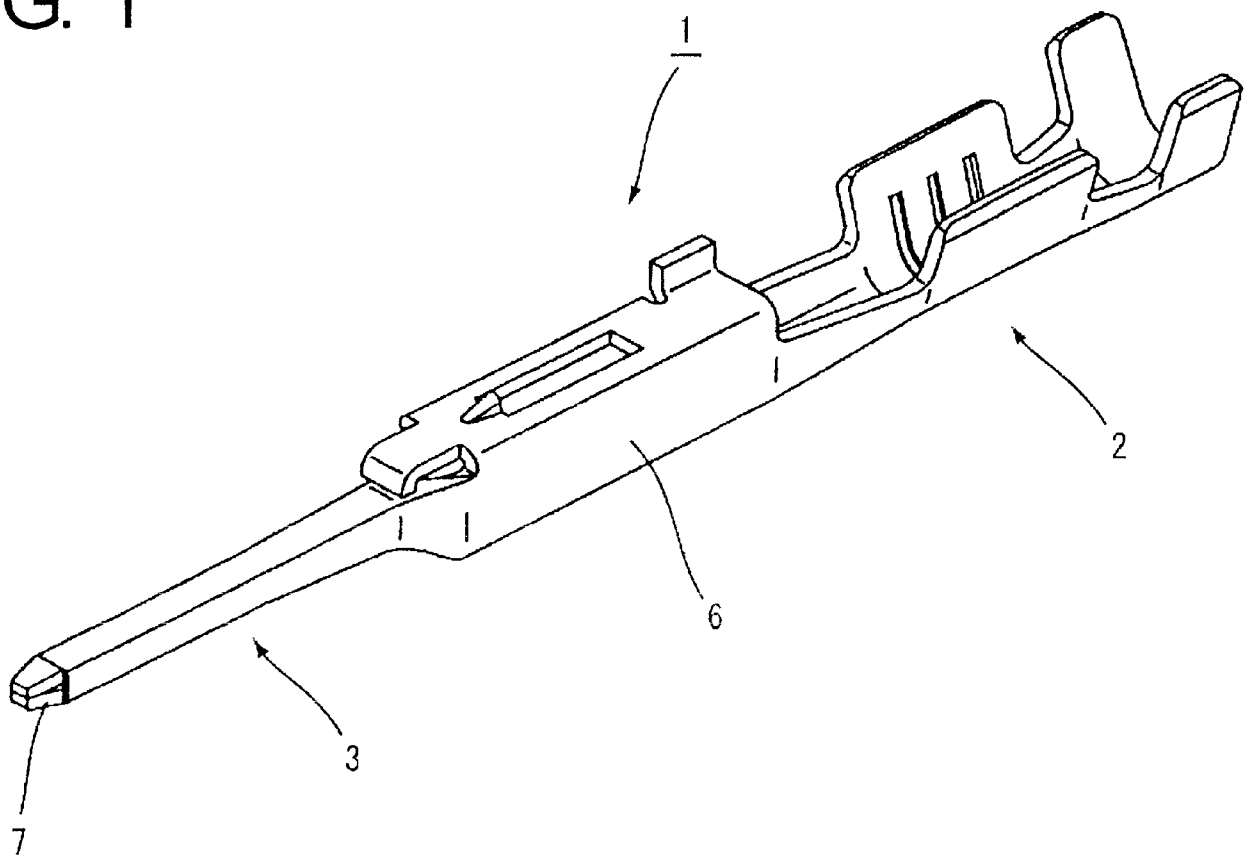
FIG. 1 is a perspective view of a male terminal fitting provided with a male tab according to one embodiment of the present invention.
Figure 2:
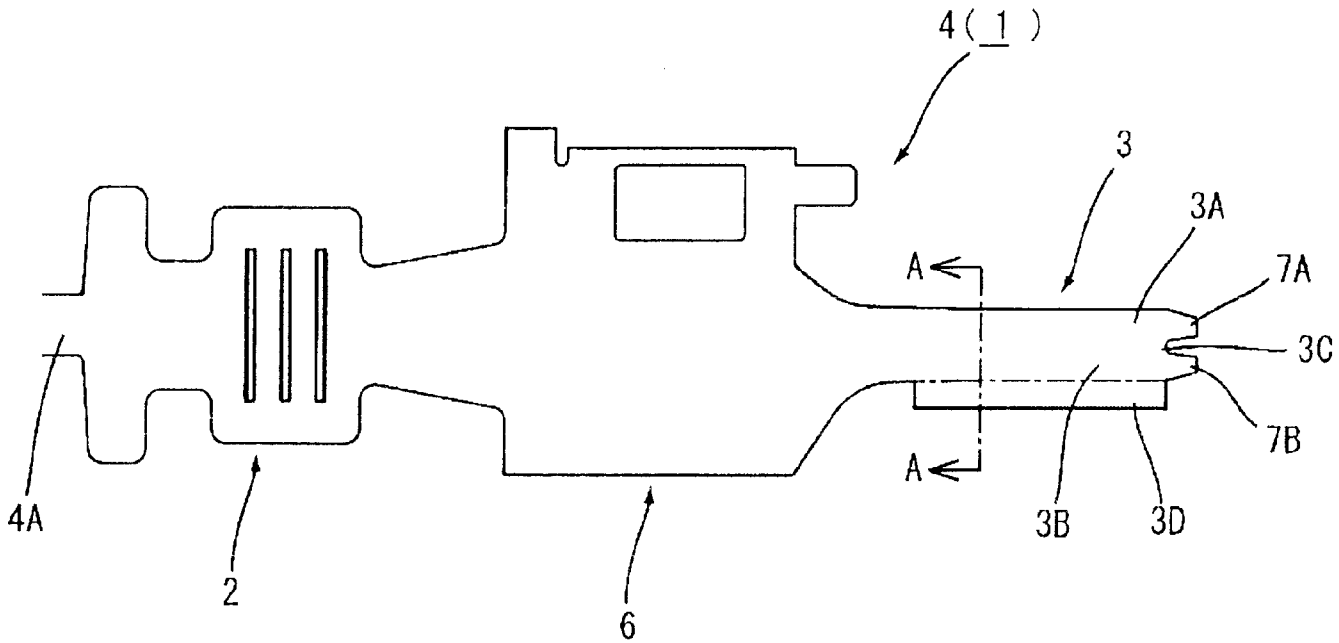
FIG. 2 is a development of the male terminal fitting.

A male terminal fitting according to the invention is identified by the numeral 1 in FIG. 1, and is formed by cutting, stamping, bending, folding and/or embossing an electrically conductive plate 4, as shown in FIG. 2. The male terminal fitting 1 has opposite front and rear ends. A wire-connecting portion 2 is formed at the rear end of the male terminal fitting 1 and is configured for connection with an end of a wire. A male tab 3 is formed at the front end of the male terminal fitting 1 and is configured for connection with an unillustrated mating female terminal fitting. The male tab 3 is produced especially in consideration of miniaturization, and one side of the front cross section of the male tab 3 is about 0.6 mm to 2 mm. A rectangular tubular support 6 is provided behind the male tab 3.

Figure 3:
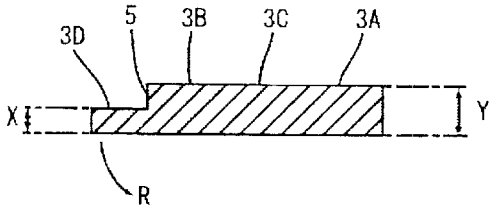
FIG. 3 is a sectional view along 3—3 of FIG. 2.
Figure 4:
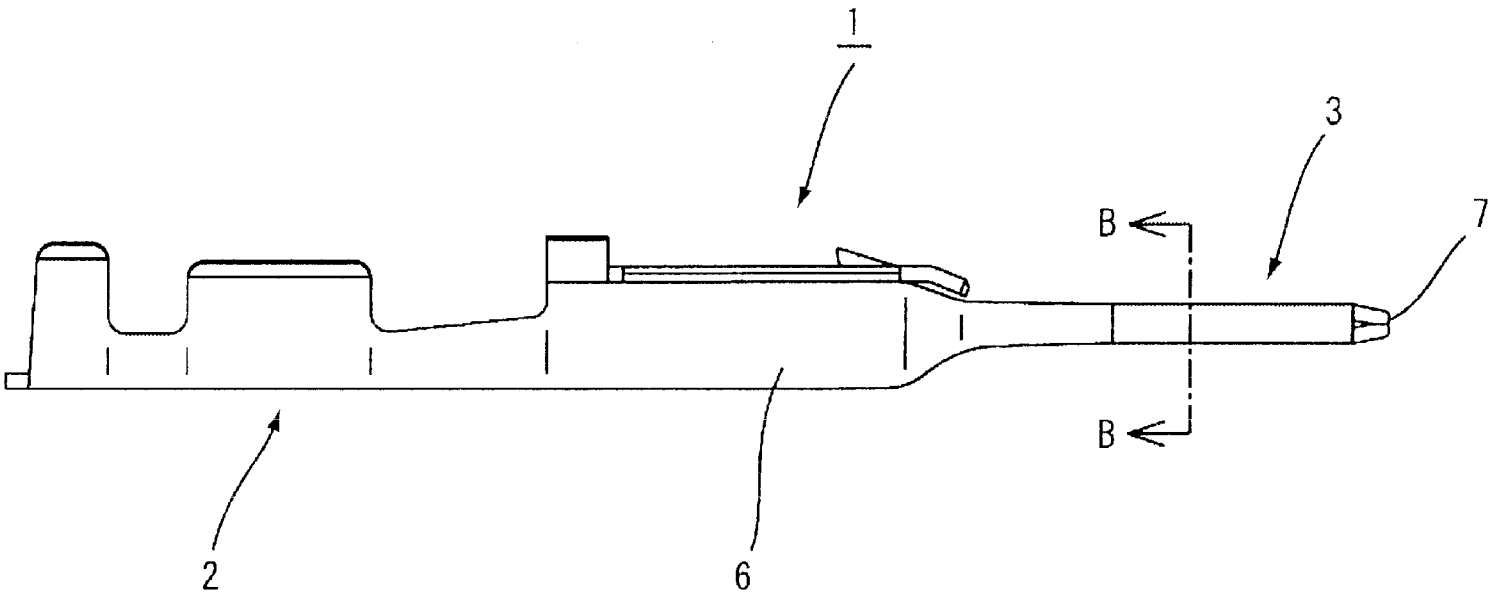
FIG. 4 is a side view of the male terminal fitting.
Figure 5:
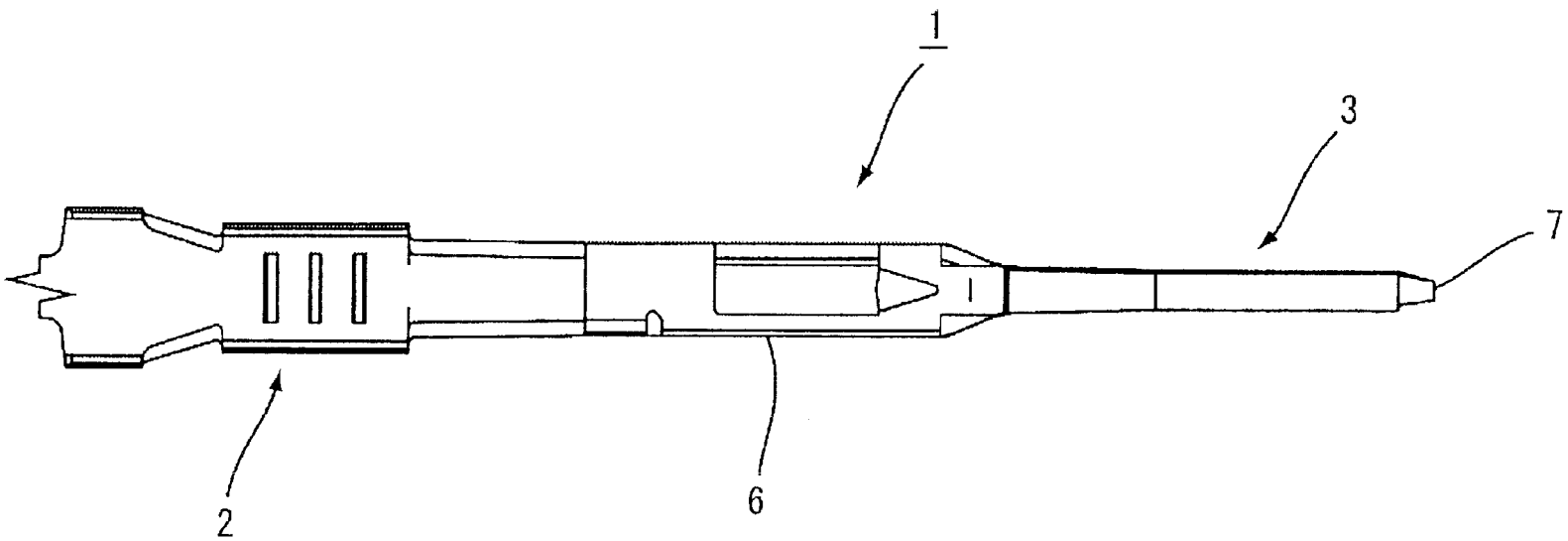
FIG. 5 is a top view of the male terminal fitting.

The electrically conductive plate 4 is bent or folded to form the male tab 3. Specifically, as shown in FIG. 2, a portion of the electric conductive plate 4 to become the male tab 3 of the male terminal fitting 1 is provided with a first panel 3A, a second panel 3B and a connecting panel 3C between the first and second panel 3A and 3B for enabling the male tab 3 to have a specified thickness T. A foldable supporting panel 3D extends along a longitudinal side of the second panel 3B substantially opposite to the first panel 3A. The foldable supporting panel 3D is pressed at a specified pressure before bending to reduce the thickness of the foldable supporting panel 3D and to define a step 5 adjacent the second panel 3B. The foldable supporting panel 3D has a thickness X, as shown in FIG. 3, that is less than a thickness Y at other locations on the male tab 3, including the first panel 3A, the second panel 3B and the connecting panel 3C (i.e. X<Y).

Trapezoidal insertion ends 7A, 7B are formed at the front ends of the first and second panels 3A, 3B of the male tab 3. The insertion ends 7A, 7B are bent substantially into contact with each other substantially at a middle position along the thickness direction TD of the male tab 3 to form an insertion end 7. The insertion end 7 may be thinned along the longitudinal direction of the male tab 3 towards its leading end.

Although not shown, a ribbon-shaped strip is provided at the left side of FIG. 2, and a plurality of electrically conductive plates 4 are connected with the strip via connecting pieces 4A at specified intervals in a direction substantially normal to the extending direction of the strip. The male terminal fittings 1 are formed by cutting, stamping, bending, folding and/or embossing while the connected plates pass through an unillustrated pressing apparatus in this state.

Figure 6:
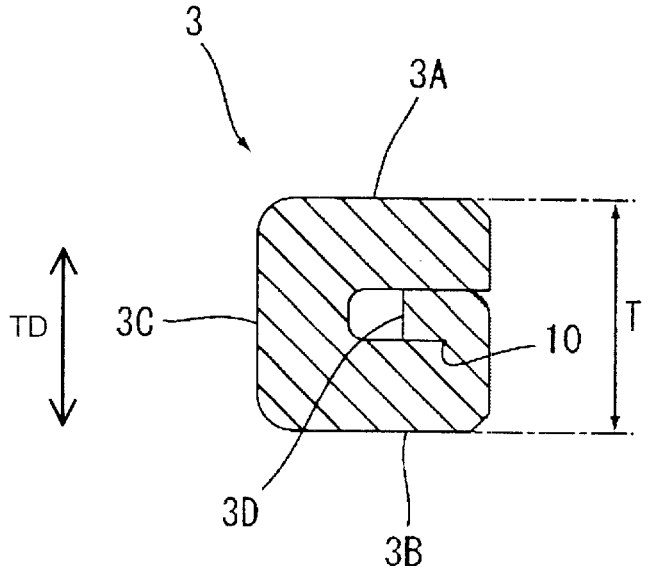
FIG. 6 is a sectional view along 6—6 of FIG. 4.

As shown in FIG. 2, the electrically conductive plates 4 are subjected to specified pressing while passing through the pressing apparatus, and thereby are formed successively into male terminal fittings 1. In this process, the foldable supporting panel 3D is folded along the step 5 in the direction of the arrow R in FIG. 3 to such a degree as to be held in close contact with the rear portion 3B. The foldable supporting panel 3D is folded substantially completely onto the second panel 3B and contacts the second panel 3B over substantially the entire area. However, it is possible that the foldable supporting panel 3D is folded onto the second panel 3B with a bending radius to leave a space between part of the foldable supporting panel 3D and the second panel 3B. Further, boundaries between the opposite sides of the connecting panel 3C and the first and second panels 3A and 3B are bent substantially at right angles. Thus, the front sectional view of the male tab 3 is substantially square or rectangular (see e.g. FIG. 6).

Figure 7:
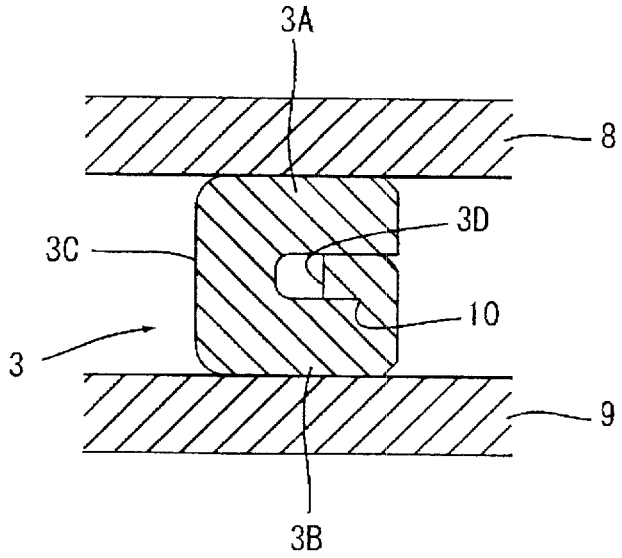
FIG. 7 is a sectional view showing the male tab being formed.
Figure 8:
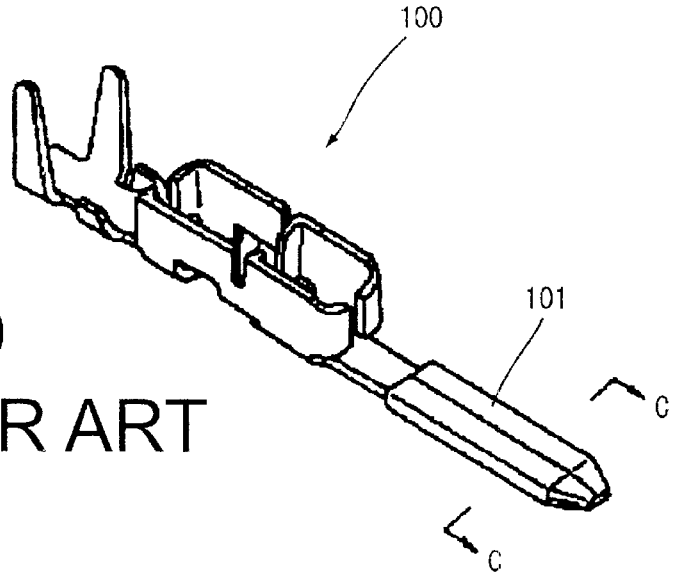
FIG. 8 PRIOR ART
FIG. 8 is a perspective view of a prior art male terminal fitting.
Figure 9:
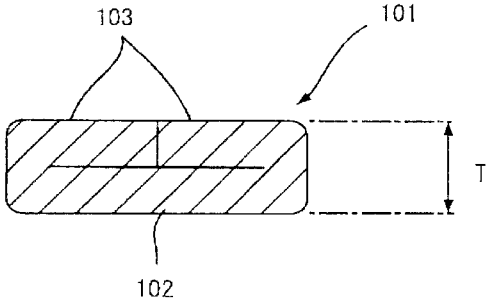
FIG. 9 PRIOR ART
FIG. 9 is a sectional view along 9—9 of FIG. 8.
Figure 10:
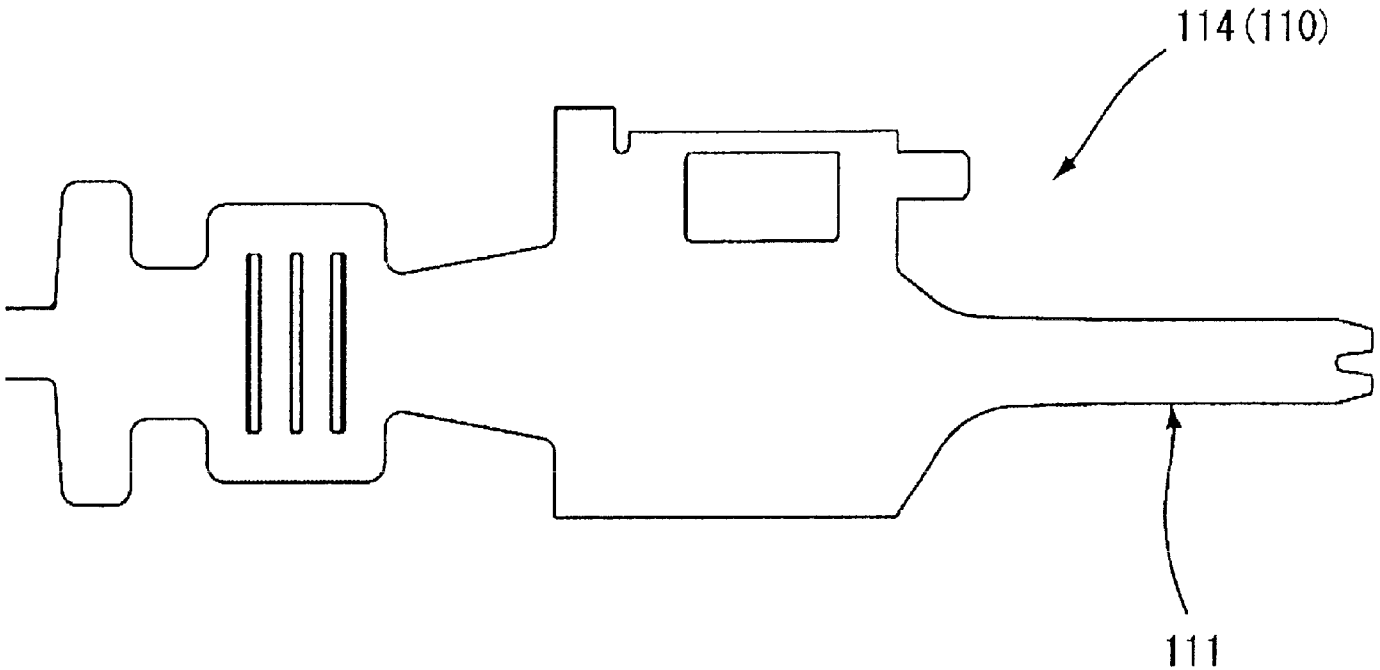
FIG. 10 PRIOR ART
FIG. 10 is a development of the male terminal fitting designed to provide a male tab having a specified thickness when an electrically conductive plate member is thin.
Figure 11:
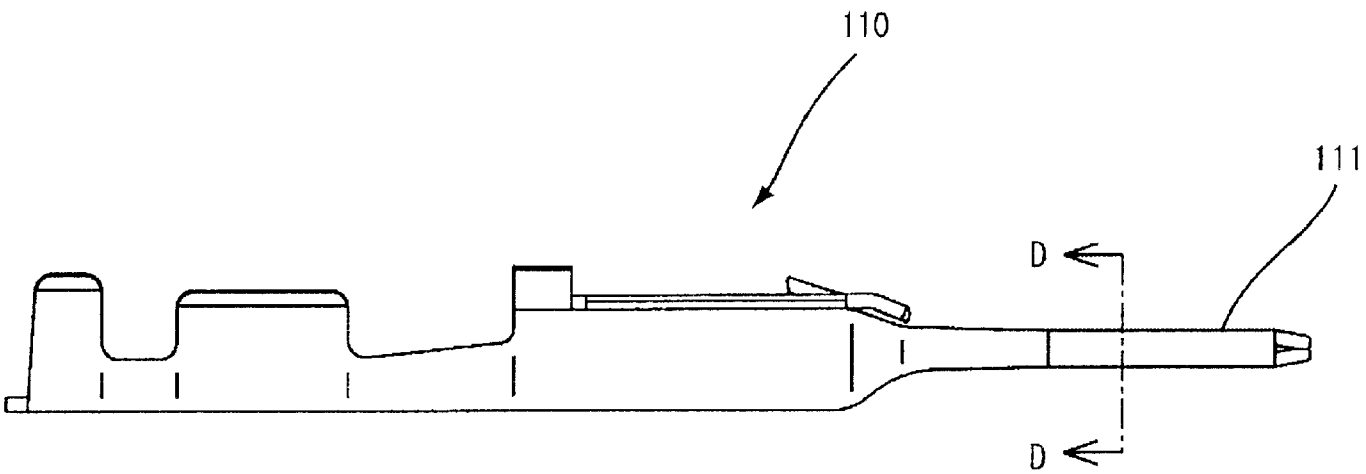
FIG. 11 PRIOR ART
FIG. 11 is a side view of the male terminal fitting when the electrically conductive plate of FIG. 10 is folded.
Figure 12:
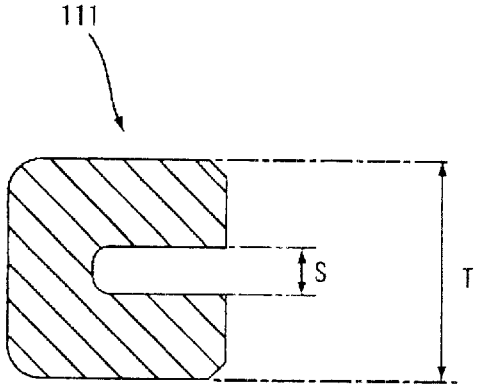
FIG. 12 PRIOR ART
FIG. 12 is a sectional view along 12—12 of FIG. 11.

The male tab 3 is pressed by upper and lower molds 8, 9, as shown in FIG. 7. Further, the foldable supporting panel 3D is held tightly or squeezed between the ends of the first and second panels 3A, 3B.

As described above, the foldable supporting panel 3D is held tightly between the ends of the first and second panels 3A, 3B of the electrical conductive plate 4. Thus, the first and second panels 3A and 3B are prevented from inclining inward along thickness direction TD during the pressing, and the male tab 3 has flatter surfaces. Further, the thickness of the male tab 3 can be enlarged as much as the thickness X of the foldable supporting panel 3D. Thus, the male tab 3 can have the specified thickness T even if the electrically conductive plate member 4 is thin.

The thickness X of the foldable supporting panel 3D is less than the thickness Y of the other parts of the electrical conductive plate 4 for the male tab 3. Thus, the foldable supporting panel 3D can be folded easily. Furthermore, the thickness X of the foldable supporting panel 3D thinner than the other parts makes it more difficult to form a space at a connecting portion 10 between the second panel 3B and the foldable supporting panel 3D at the underside of the step 5 when the foldable supporting panel 3D is folded. Therefore, dimensional errors along the thickness direction of the male tab 3 can be reduced.

Figure 13:
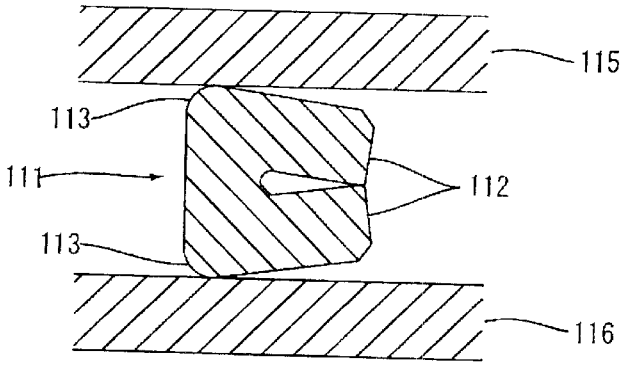
FIG. 13 PRIOR ART
FIG. 13 is a sectional view showing a state where the male tab shown in FIG. 12 is formed by pressing.

Further, even if the male tab 3 is connected with the female terminal fitting for a long time, the foldable supporting panel 3D prevents the inward inclination along the thickness direction TD of the male tab 3, see FIG. 13 of the first and second panels 3A, 3B, thereby keeping good contact.

Accordingly, the method for forming a male tab comprises pressing a conductive plate 4 to form a supporting panel 3D having a specified thickness X that is less than the thickness Y of the conductive plate 4. The method continues by folding the supporting panel onto the first and/or second panel 3A, 3B. The method then includes bending the conductive plate 4 such that the first and second panels 3A, 3B are substantially parallel and substantially face each other with the supporting panel 3D sandwiched therebetween. Thus, the supporting panel 3D is folded onto the second panel 3B and contacts the first panel 3A for holding the first and second panels 3A and 3B at a distance and supported on each other. Accordingly, the first panel 3A substantially contacts and is near the supporting panel 3D and is substantially in contact with and near the second panel 3B along the thickness direction TD.

What is claimed is:

1. A male tab formed unitarily from a folded electrically conductive plate, said male tab comprising a first panel having a selected thickness, a second panel disposed over and spaced from the first panel, the second panel having a selected thickness, and at least one supporting panel, the supporting panel extending unitarily from a side of the second panel and being folded and held tightly between the first and second panels, the supporting panel having a thickness less than the thicknesses of the first and second panels.

2. The male tab of claim 1, further comprising a connecting panel extending unitarily between the first and second panels (3A, 3B) from a side of the first panel (3A) substantially opposite the supporting panel (3D).

3. The male tab of claim 2, wherein the first and second panels are maintained in their positional relationship by the supporting panel and by the connecting panel.

4. The male tab of claim 2, wherein the first and second panels are substantially parallel.

5. A male terminal fitting formed from an electrically conductive plate and comprising a wire connecting portion configured for connection to a wire and a male tab, the male tab including a first panel having a selected thickness, a second panel disposed over and spaced from the first panel, the second panel having a selected thickness, and at least one supporting panel, the supporting panel extending unitarily from a side of the second panel and being folded and held tightly between the first and second panels, the supporting panel having a thickness less than the thicknesses of the first and second panels.

6. The male terminal fitting of claim 5, wherein the male tab and the wire-connecting portion are unitary with one another.

7. A method of forming a male tab, comprising:

stamping an electrically conductive plate to define a planar development with opposite first and second surfaces and opposite first and second side edges;

pressing the plate at locations in proximity to the first side edge to define a pressed portion of the plate in proximity to the first side edge and having a thickness less than thicknesses at other parts of the plate;

folding the pressed portion of the plate along a first fold line so that a portion of the plate between the first fold line and the first edge defines a supporting panel lying in face-to-face contact with a portion of the first surface;

folding the plate along a second fold line parallel to the first fold line to define a first panel between the first and second fold lines, and to define a connecting panel extending from the second fold line; and folding the plate about a third fold line parallel to the first and second fold lines and between the connecting panel and the second edge to define a second panel opposed to the first panel and supported at least partly on the supporting panel.

8. The method of claim 7, wherein the plate is folded so that the connecting panel is substantially normal to the first and second panels.

9. The method of claim 8, wherein the plate is folded so that the first and second panels are substantially parallel.

* * * * *